US008733759B1

(12) United States Patent
Donahoo

(10) Patent No.: US 8,733,759 B1
(45) **Date of Patent: *May 27, 2014**

(54) MATCHING GAMES AND SYSTEMS FOR IMPLEMENTING MATCHING GAMES

(71) Applicant: JJJJacks, LLC, Sunrise Beach, MO (US)

(72) Inventor: Don D. Donahoo, Leawood, KS (US)

(73) Assignee: JJJJacks, LLC, Sunrise Beach, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/734,461

(22) Filed: Jan. 4, 2013

Related U.S. Application Data

(63) Continuation of application No. 13/092,666, filed on Apr. 2, 2011, now Pat. No. 8,376,364.

(60) Provisional application No. 61/329,409, filed on Apr. 29, 2010.

(51) Int. Cl.
*A63F 1/00* (2006.01)
*A63F 9/24* (2006.01)

(52) U.S. Cl.
USPC ..... 273/292; 463/36

(58) Field of Classification Search
USPC ..... 463/17–31
See application file for complete search history.

(56) References Cited

U.S. PATENT DOCUMENTS

| | | | |
|---|---|---|---|
| 2003/0030217 | A1 | 2/2003 | Webb |
| 2003/0153380 | A1 | 8/2003 | Dreaper et al. |
| 2005/0035547 | A1 | 2/2005 | Henry |
| 2006/0287066 | A1 | 12/2006 | Crawford et al. |
| 2009/0146375 | A1 | 6/2009 | Stanton |

*Primary Examiner* — Masud Ahmed
(74) *Attorney, Agent, or Firm* — Lathrop & Gage LLP

(57) ABSTRACT

One method of conducting a game includes steps: (a) providing first and second decks of cards; (b) accepting a predetermined number of uniform wagers from players; (c) associating with each wager a predetermined number of cards from the first and second decks; (d) after the predetermined number of wagers are accepted, selecting the predetermined number of cards from the first and second decks; (e) determining whether the cards selected after the predetermined number of wagers are accepted matches exactly the cards associated with any wager; (f) performing steps (d) and (e) without further wagering until cards selected after the predetermined number of wagers are accepted matches the cards associated with any wager; and (g) awarding a payout dependent on the number of wagers accepted, the amount of each wager, and the number of players having cards that match the cards selected after the predetermined number of wagers are accepted.

15 Claims, 11 Drawing Sheets

410a

HOME HOW TO PLAY REGISTER SIGN-IN PLAY JJJJACKS TABLE PLAY WINNERS FAQ

WELCOME: PLAYER 1 / LOG OUT

CONGRATULATIONS!

YOUR PLAYERS HAND # 02.08.10-H123456789

HAS BEEN CONFIRMED AND YOUR $1 ANTE BET HAS BEEN PLACED AT

GAME/TABLE # 02.08.10-T1234

CONFIRMATION # XXXXXXXXXXX

- This INFORMATION, and a Description of Your CONFIRMED Players Hand, has been LOGGED-INTO Your ACCOUNT and Emailed to Your Email Address. Select PRINT COPY to Print a Hard Copy
- Your $1 Ante Bet has been Debited from Your ACCOUNT
- Visit TABLE PLAY and ENTER Your GAME/TABLE Number to: 1.) Watch ACTIVE TABLE PLAY of Your Game If It is Currently IN PROGRESS, or 2.) View a SUMMARY of Your Game and its WINNING HAND If Play has Already BEEN COMPLETED
- If This Players Hand Becomes a WINNING HAND, You will be Contacted by Email shortly after Your Game is Completed; You may Also Contact Us by Selecting the CONTACT US Link at the Bottom of this page, and then Following the WINNING HAND Link from the Drop-Down List

FIG. 9

MATCHING GAMES AND SYSTEMS FOR IMPLEMENTING MATCHING GAMES

CROSS-REFERENCE TO RELATED APPLICATIONS

This application is a continuation of U.S. patent application Ser. No. 13/092,666, filed Apr. 22, 2011 which claims priority to U.S. Provisional Patent Application No. 61/329,409, filed Apr. 29, 2010, the disclosures of which are incorporated herein by reference in its entirety.

BACKGROUND OF THE INVENTION

Lotteries come in many popular formats ranging from instant games using lottery tickets known as "scratch cards"; to periodic, long-odds, large jackpot games such as Powerball® games. While the purchase of a lottery ticket is considered irrational from the perspective of classical economics, it clearly enables some purchasers to experience the thrill of the chance of winning a large "jackpot" prize and to indulge in the fantasy of "becoming wealthy". Even though many lotteries pay lesser prizes for matching just some of the winning numbers (to increase the odds of players winning at least something), the reality is that each lottery ticket or card typically has only one chance of winning per individual lottery game, the odds of winning the lottery "jackpot" prize are extremely poor, most large jackpot lottery games are periodic with limited play each week, and most individual lottery games do not produce a "jackpot" winner.

Keno is a lottery-like or bingo-like game played in many casinos and also offered in some state lottery systems. Players are paid based on: (a) how many numbers on their ticket, if any, match the numbers drawn; and (b) the paytable selected and the amount wagered. While keno games also pay lesser prizes for matching just some of the numbers drawn, the odds of winning any of the "large prizes" are extremely poor and most keno games do not produce a "large prize" winner.

A card game is any game using "playing cards", be they traditional or game-specific, as the primary medium with which the game is played. Card games typically involve the "shuffling", "dealing", and/or "drawing" of these playing cards, and many of them use a "dealer". Popular casino card games include games such as "Poker" where players compete against each other to win the "pot", and games such as "Blackjack" where players compete against the "house" to win. In each "play" of each of these card games, while the "maximum amount" a player can win varies according to his wager(s), there is always a "winner" of that "maximum amount", or multiple "winners" splitting that "maximum amount".

Most card games strictly limit the number of players allowed per game, while others are self-limiting due to the total number of cards available for play; accordingly, most card games accommodate 10 or fewer players. Because of the limited number of players, the "maximum amount" available to win in each game is often much less than the large "jackpots" typically seen in most lottery games.

SUMMARY OF THE INVENTION

Games and methods and systems of implementing the games are provided. One method of conducting a game includes the steps: (a) providing a first set of choices; (b) providing a second set of choices; (c) accepting a predetermined number of wagers from a plurality of players; (d) associating with each wager a predetermined number of elements from the first set and a predetermined number of elements from the second set; (e) after the predetermined number of wagers are accepted, selecting the predetermined number of elements from the first set and the predetermined number of elements from the second set; (f) determining whether the elements selected after the predetermined number of wagers are accepted matches exactly the elements associated with any wager; (g) performing steps (e) and (f) without further wagering until the elements selected after the predetermined number of wagers are accepted matches exactly the elements associated with any wager; and (h) awarding a prize to at least one player having elements that exactly match the elements selected after the predetermined number of wagers are accepted.

Another method of conducting a game includes the steps: (a) providing a first deck of cards; (b) providing a second deck of cards; (c) accepting a predetermined number of uniform wagers from a plurality of players; (d) associating with each wager a predetermined number of cards from the first deck and a predetermined number of cards from the second deck; (e) after the predetermined number of wagers are accepted, selecting the predetermined number of cards from the first deck and the predetermined number of cards from the second deck; (f) determining whether the cards selected after the predetermined number of wagers are accepted matches exactly the cards associated with any wager; (g) performing steps (e) and (f) without further wagering until the cards selected after the predetermined number of wagers are accepted matches the cards associated with any wager; and (h) awarding a payout dependent on the number of wagers accepted, the amount of each wager, and the number of players having cards that match the cards selected after the predetermined number of wagers are accepted.

One method of playing a game includes a plurality of people. Each person selects a first number of cards from a first deck of cards, selects a second number of cards from a second deck of cards, and places a wager associated with the cards selected from the first and second decks. After a predetermined number of wagers are placed, the first number of cards are selected from the first deck and the second number of cards are selected from the second deck without delay until at least one of the people has matching cards.

In one embodiment, a computer has a processor in data communication with an electronic memory, an input device, an output device, and programming for implementing a game. The programming causes the processor to implement steps: (a) providing a first deck of electronic cards; (b) providing a second deck of electronic cards; (c) accepting a predetermined number of uniform wagers from a plurality of players; (d) associating with each wager a predetermined number of cards from the first deck and a predetermined number of cards from the second deck; (e) after the predetermined number of wagers are accepted, selecting the predetermined number of cards from the first deck and the predetermined number of cards from the second deck; (f) determining whether the cards selected after the predetermined number of wagers are accepted matches exactly the cards associated with any wager; (g) performing steps (e) and (f) without accepting further wagering until the cards selected after the predetermined number of wagers are accepted matches the cards associated with any wager; and (h) awarding a payout dependent on the number of wagers accepted, the amount of each wager, and the number of players having cards that match the cards selected after the predetermined number of wagers are accepted.

BRIEF DESCRIPTION OF THE DRAWINGS

FIGS. 5-11 show exemplary screen shots of the implementation of FIG. 4.

DETAILED DESCRIPTION

Figure 1:
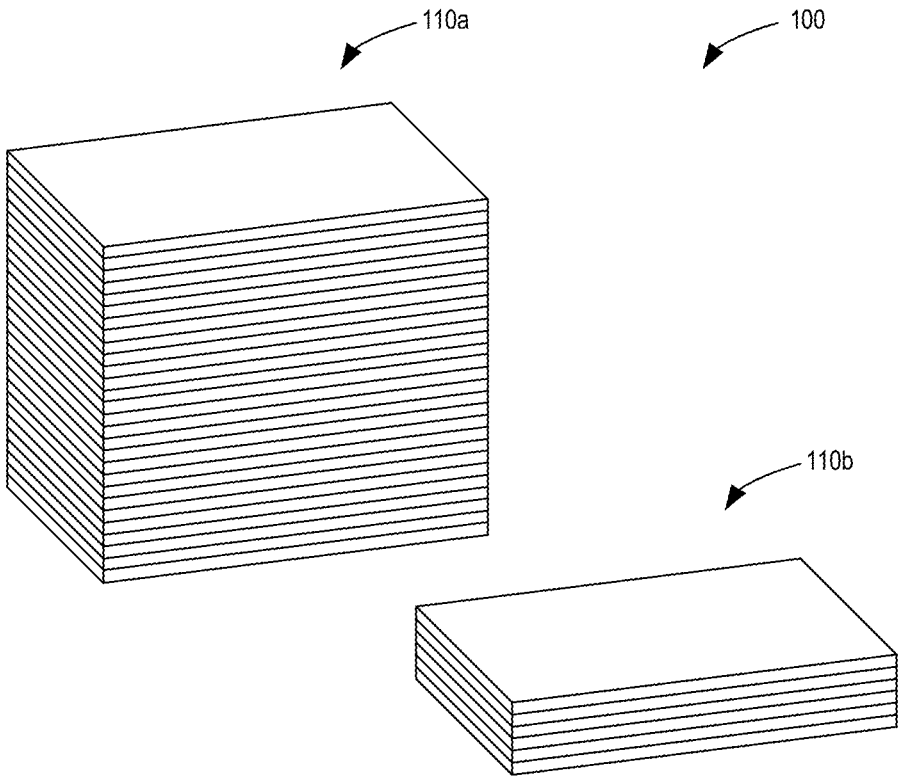
FIG. 1 is a perspective view of a game according to an embodiment.

Embodiments of the present invention provide games and methods and systems of implementing the games. In one embodiment, a game 100 (FIG. 1) includes a first plurality (or "deck") of cards 110*a* and a second plurality (or "deck") of cards 110*b* that may differ from the cards 110*a*. A plurality of players make wagers, and each player selects a predetermined number of cards from the first deck 110*a* and a predetermined number of cards from the second deck 110*b*. To allow multiple players to obtain the same or similar selections, either the selections of each player are memorialized (e.g., written, input into a computer for saving and/or printing, et cetera), or multiple decks 110*a*, 110*b* are used. If multiple decks are used, marking may be included that identify the different decks to ensure that selections are not altered through trading between players. After all player selections are made, a dealer selects the predetermined number of cards from the first deck 110*a* and the predetermined number of cards from the second deck 110*b*. If the dealer's selections match those of a player, the player wins all (or a portion of) the wagers that were made. If the dealer's selections do not match those of a player, the dealer re-selects the predetermined number of cards from the first deck 110*a* and the predetermined number of cards from the second deck 110*b*, and the dealer continues this routine until the dealer's selections match those of a player. If multiple players have selections that match those of the dealer, those players share in winning at least a portion of the wagers that were made.

Figure 2:
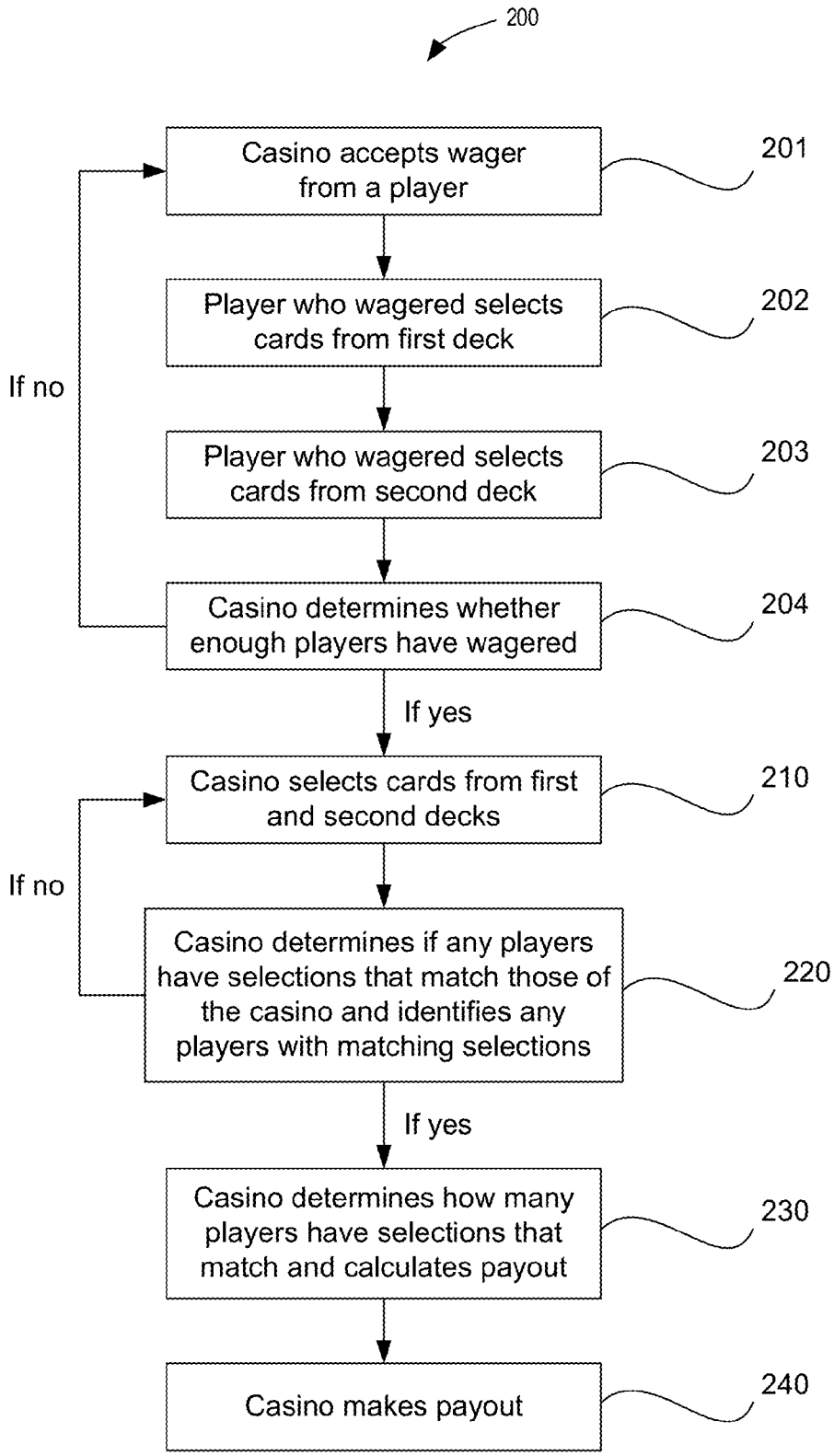
FIG. 2 is a flowchart showing an exemplary implementation of the game of FIG. 1.

One exemplary implementation 200 of the game 100 is shown in the flowchart of FIG. 2. In a gaming establishment (referred to herein as a "casino"), the first deck of cards 110*a* is provided as a standard 52-card poker deck (with four suits each having nine numbered cards and four face cards), and the second deck of cards 110*b* is provided as a set of four cards. At step 201, the casino accepts a wager from a player, and the method proceeds to step 202. At step 202, the player who wagered either selects five cards (the predetermined number in the current example) from the first deck 110*a* or accepts five cards from the first deck 110*a* that are selected by the casino. The method then proceeds to step 203, where the player who wagered either selects one card (the predetermined number in the current example) from the second deck 110*b* or accepts one card from the second deck 110*b* that is selected by the casino. Some embodiments may allow the player to know what cards are being selected as the cards are actually selected at steps 202, 203, while other embodiments may place the cards "face down" or take other actions to hide the identity of the cards as their selection is made. And, as discussed above, the selections may be memorialized such that all players use the same decks 110*a*, 110*b*, or multiple decks 110*a*, 110*b* may be used to allow the players to hold the selected cards without reducing the number of cards subsequently available for selection.

From step 203, the method 200 advances to step 204, where the casino determines whether enough players have wagered to proceed to step 210. If not, the method 200 returns to step 201 to accept another wager. If enough players have wagered, the method proceeds from step 204 to step 210.

At step 210, the casino selects five cards from the first deck 110*a* and selects one card from the second deck 110*b* (again, the predetermined numbers in the current example). The method 200 continues to step 220, where the casino determines if any players have selections that match those of the casino and identifies any players with matching selections. So if, for example, the casino selected queen and ace of spades, six of hearts, ace of diamonds, ten of clubs, and a first of the four cards in deck 110*b*, the casino would determine if any players selected queen and ace of spades, six of hearts, ace of diamonds, ten of clubs, and the first card in deck 110*b*. If no player has matching selections, the method 200 immediately returns to step 210 to again select five cards from the first deck 110*a* and one card from the second deck 110*b*.

If at least one player does have matching selections, the method 200 advances from step 220 to step 230, where the casino determines how many players were identified in step 220 as having matching selections and calculates a payout for each player having matching selections. In calculating payout (s) at step 230, the casino may for example deduct a percentage or a set amount from the total amount wagered to be allocated to such things as operating expenses and revenue, and the remainder may be divided evenly between the winning players. If the casino only proceeds to step 210 when a preselected number of players have wagered, the players may know a payout schedule in advance of wagering at step 201, with different payouts being identified for different numbers of winners.

The method finally ends at step 240, where payouts are made in accordance with the determinations at step 230 and any deducted amount is properly deposited. While steps have been described as being performed in a particular order, various embodiments may utilize different sequences and/or different steps. For example, in some embodiments, steps 202, 203 may be performed before step 201; and in some embodiments, the game 100 may be implemented without any wager or payment.

While some embodiments may require the players to remain present from the wager to the identification of a winner, other embodiments may not require such attendance. It may be particularly desirable to not require players to remain present if the dealer does not make a selection until many players make wagers.

Figure 3:
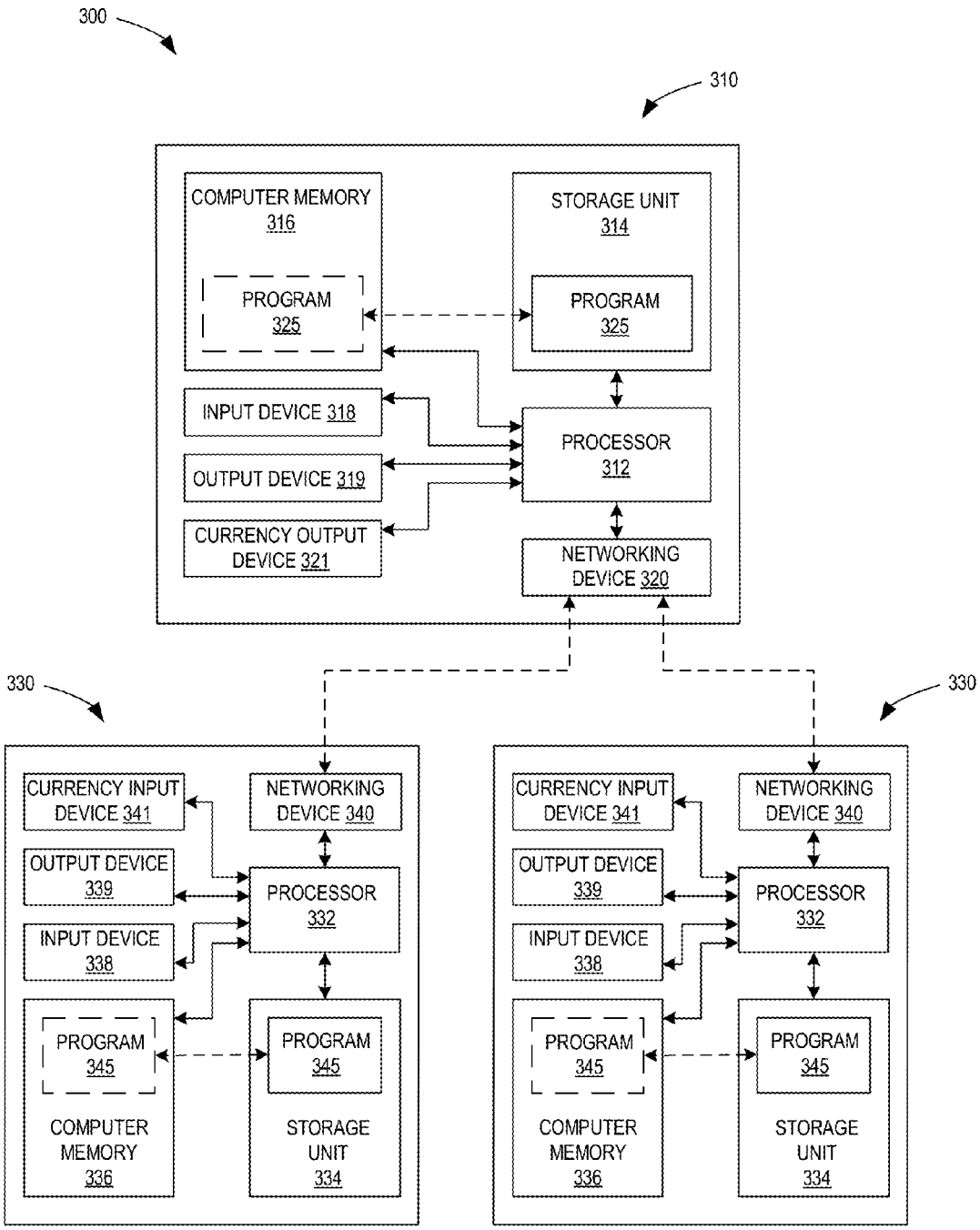
FIG. 3 shows an exemplary system for implementing the game of FIG. 1.
Figure 4:
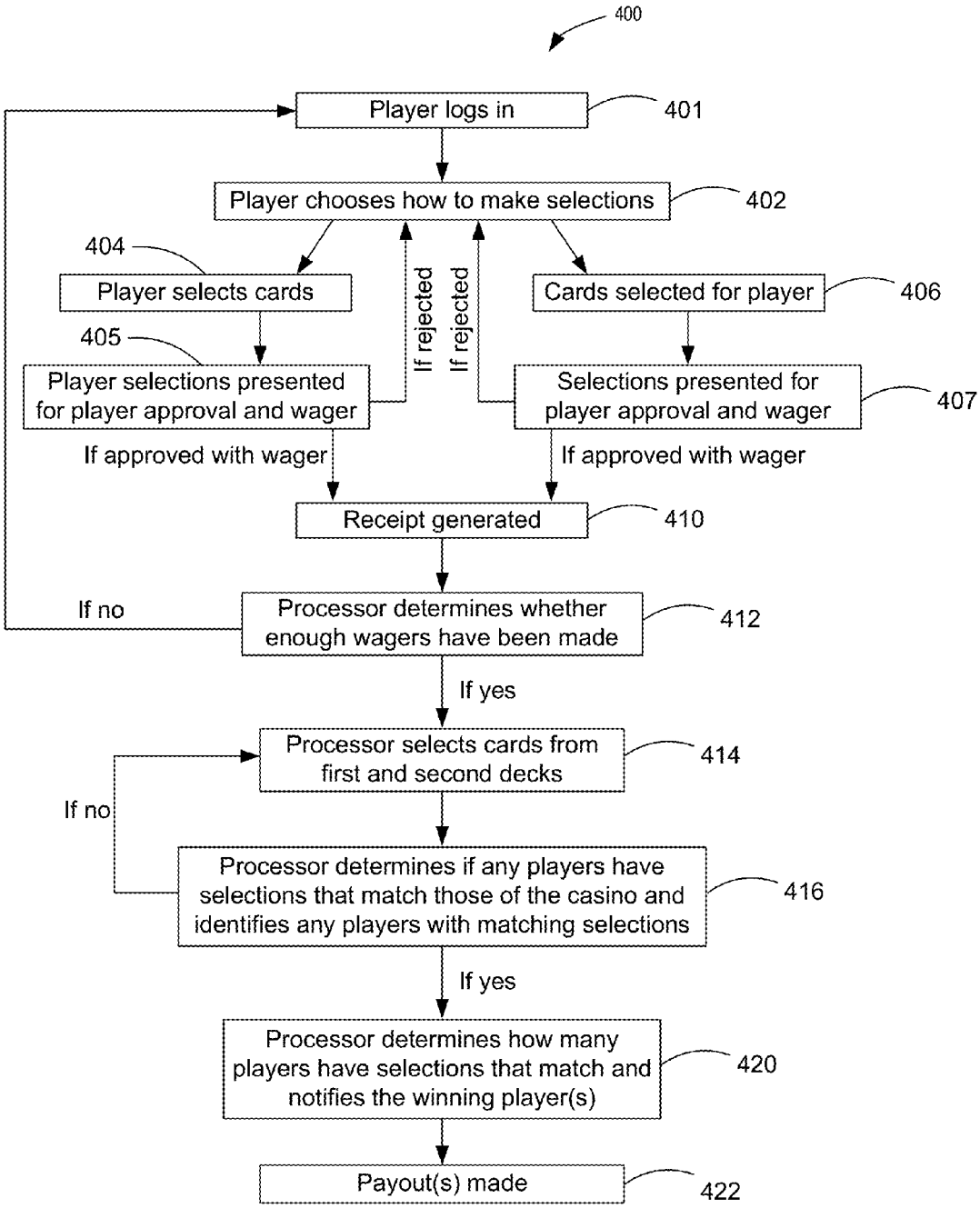
FIG. 4 is a flowchart showing another exemplary implementation of the game of FIG. 1.

FIG. 3 shows a system 300 that allows the game 100 to be played electronically by people at different locations and/or times. The system 300 includes a primary station 310 and a plurality of secondary stations 330. While two secondary stations 330 are shown in FIG. 3, it should be understood that the system 300 may include three or more secondary stations 330, or only one secondary station 330. And different embodiments may omit all secondary stations 330, in which case the functionality described for the secondary stations 330 is incorporated into the primary station 310.

In embodiment 300, the primary station 310 has a processor 312 in data communication with a storage unit 314, a computer memory 316, an input device 318, an output device 319, a networking device 320, and a currency output device 321. The storage unit 314 may be, for example, a disk drive that stores programs, and the storage unit 314 is illustratively shown storing a program 325 embodying steps and methods to implement the game 100. It should be understood that the program 325 could be broken into subprograms and stored in multiple storage units of one or more computers and that data could be transferred between those storage units using methods known in the art. A dashed outline within the computer memory 316 represents the software program 325 loaded into the computer memory 316 and executed by the processor 312, and a dashed line between the storage unit 314 and the computer memory 316 illustrates the transfer of the program 325 between the storage unit 314 and the computer memory 316. The input device 318 may be any desirable input device(s), such as a keyboard, a touch screen, a scanner, et cetera, and the output device 319 may be any desirable output device(s), such as a display, an audible output device, a printer, et cetera. The currency output device 321 may, for example, be a device for dispensing paper currency, coins, making electronic transfers of funds, et cetera.

The secondary stations 330 may be gaming stations inside a casino or other establishment, or may be located in multiple casinos or other establishments. In some embodiments, personal computers or mobile Internet devices (e.g., iPad™ and other tablet devices, smart phones, laptop computers, and other wireless devices now in existence or later developed—including those that use networks besides the Internet) may be secondary stations 330. Each secondary station 330 shown in FIG. 3 includes a processor 332 in data communication with a storage unit 334, a computer memory 336, an input device 338, an output device 339, a networking device 340, and a currency input device 341. The storage unit 334 may be, for example, a disk drive that stores programs, and the storage unit 334 is illustratively shown storing a program 345 embodying steps and methods to implement the game 100. As with the program 325, it should be understood that the program 345 could be broken into subprograms and stored in multiple storage units of one or more computers and that data could be transferred between those storage units using methods known in the art. A dashed outline within the computer memory 336 represents the software program 345 loaded into the computer memory 336 and executed by the processor 332, and a dashed line between the storage unit 334 and the computer memory 336 illustrates the transfer of the program 345 between the storage unit 334 and the computer memory 336. The input device 338 may be any desirable input device(s), such as a keyboard, a touch screen, a scanner, et cetera, and the output device 339 may be any desirable output device(s), such as a display, an audible output device, a printer, et cetera. The currency input device 341 may, for example, be a device for accepting paper currency, coins, debit cards, credit cards, or other electronic transfers of funds, et cetera.

The programs 325, 345 allow the game 100 to be implemented electronically using the primary and secondary stations 310, 330, and the networking devices 320, 340 allow communication between the primary and secondary stations 310, 330. So, with reference again to FIG. 2 to provide another example, the deck of cards 110*a*, 110*b* may be electronic instead of physical. A player may approach one of the secondary stations 330, and the wager may be made at step 201 using the secondary station's currency input device 341. The programs 325, 345 may allow the player to select cards at steps 202, 203 using the input device 338, and the selections may be input into the storage units 314, 334, and record of the selections may be output (e.g., printed) using the output device 339. Using the programming 325, the processor 312 may make the determination at step 204, may make the selections at step 210, may make the determinations and calculations at steps 220, 230, and may make the payouts at step 240.

Notably, electronic implementation of the game 100 may allow large numbers of players to compete in a card game which begins play based upon player demand rather than a set, periodic schedule, and in which each play, upon its completion, pays out a guaranteed prize that is split if there are multiple winners. Aspects such as odds of winning, wager amount, number of players, and portion of wagers to be paid out can clearly be adjusted to provide different game experiences.

FIGS. 4 through 11 illustrate another implementation 400 of the game 100 and the system 300, with personal computers and/or mobile Internet devices being some or all of the secondary stations 330. At step 401, a player accesses the primary station 310 using a personal computer 330 (via the networking devices 320, 340) and accesses or creates an account that identifies the player to the primary station 310 and associates a particular method of paying (e.g., credit card information) with the player.

Figure 5:
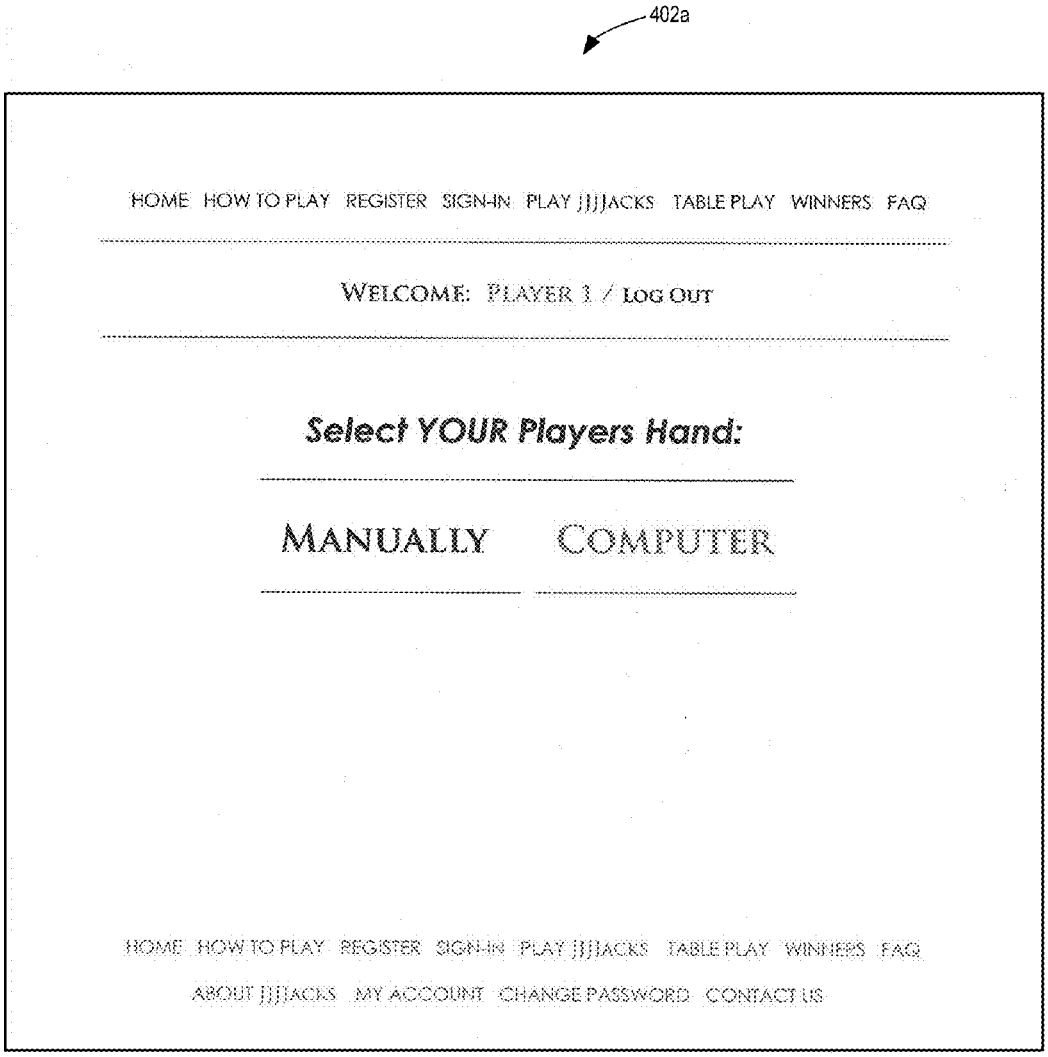

The method proceeds from step 401 to step 402, where a display 339 of the personal computer 330 presents the player with the option of making his own selections or having his selections be randomly generated. Exemplary screen shot 402*a*, illustrating step 402, is shown in FIG. 5. If the player chooses (using the input device 338) to make his own selections, the method continues to step 404. If the player instead chooses (using the input device 338) to have his selections be randomly generated, the method moves from step 402 to step 406.

Figure 6:
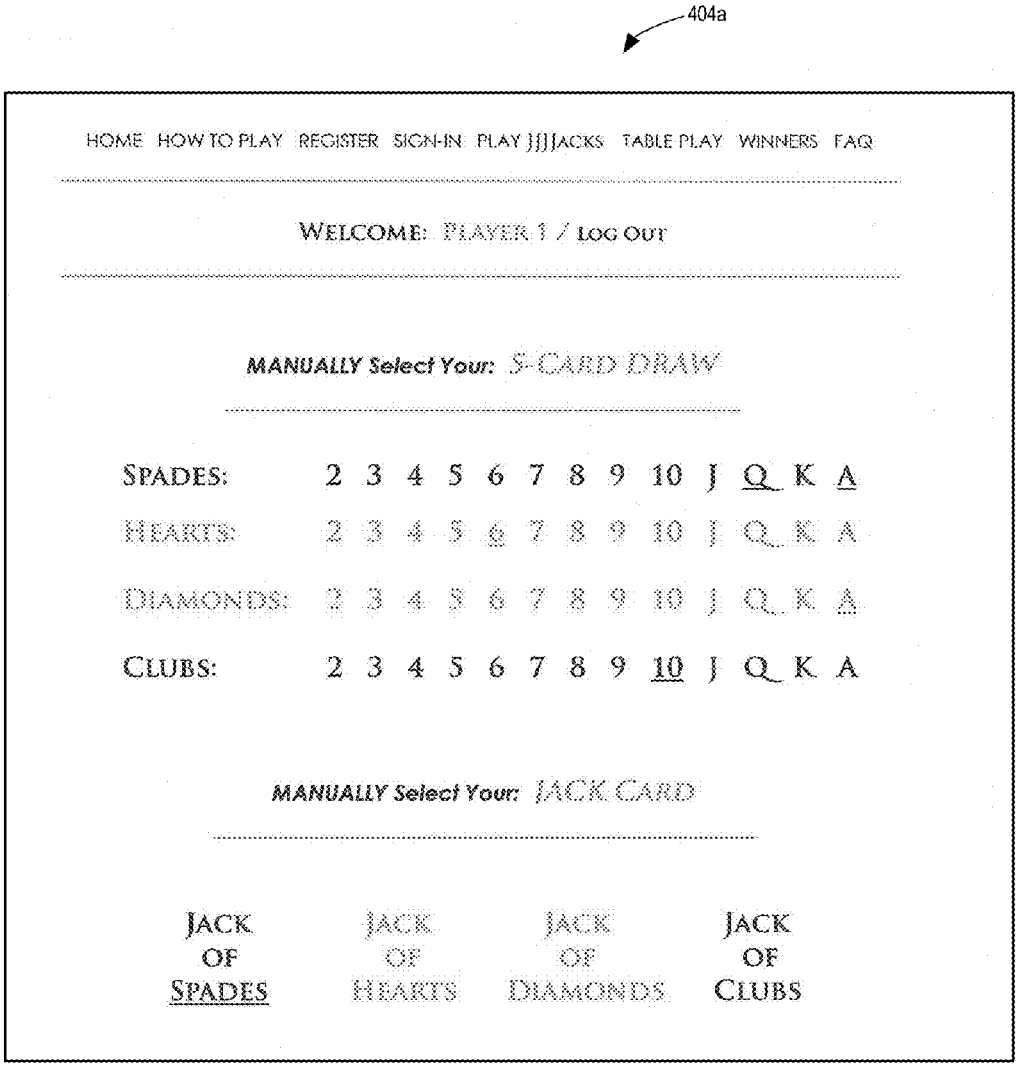

At step 404, the player selects five cards (the predetermined number in the current example) from the electronic first deck 110*a* and one card (the predetermined number in the current example) from the electronic second deck 110*b*. FIG. 6 shows an exemplary screen shot 404*a* illustrating step 404, with the selected cards underlined.

Figure 7:
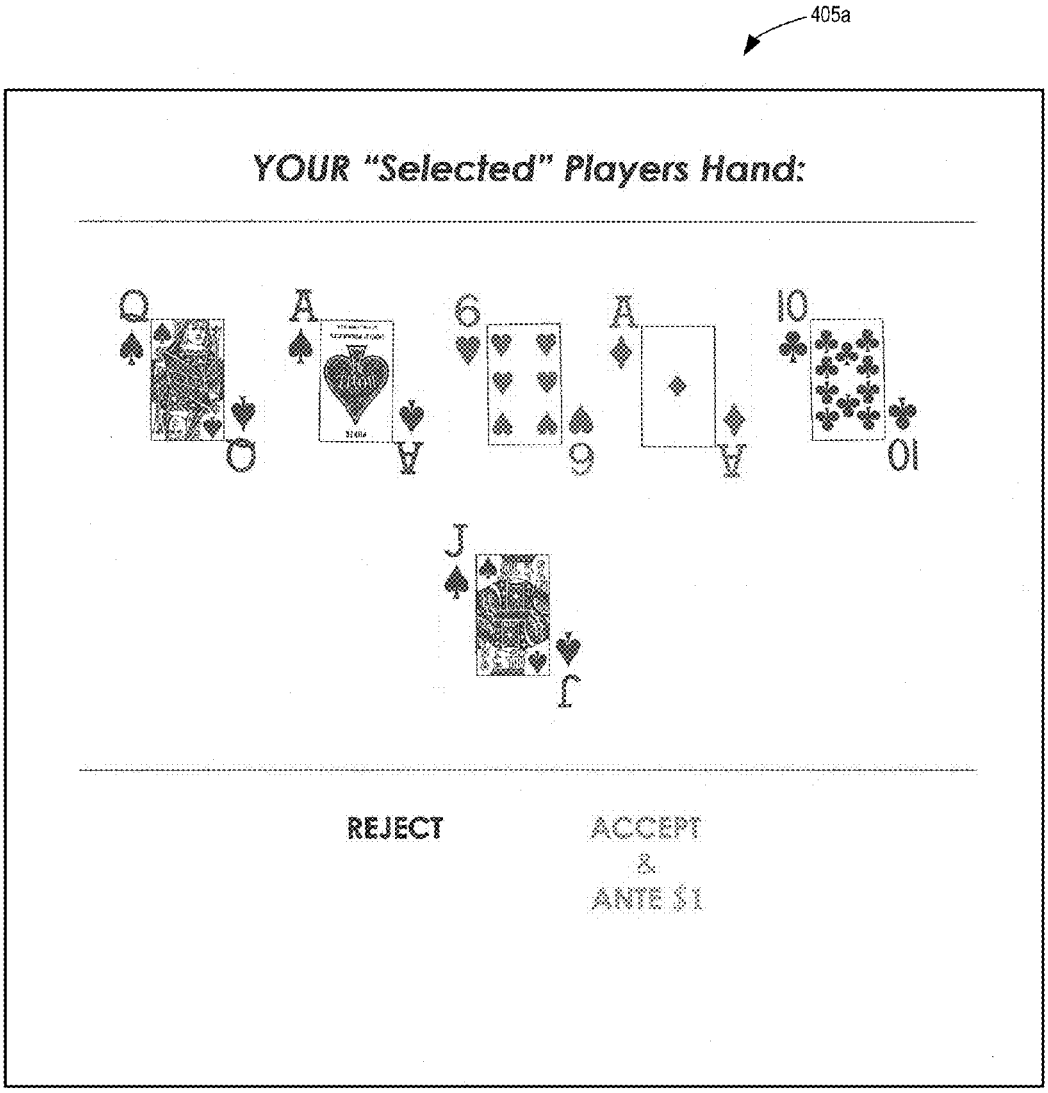

From step 404, the method 400 proceeds to step 405, where the selected cards are displayed by the computer display 339. The player is presented with the option of accepting the selections made in step 404 and placing a wager or rejecting the selections made at step 404. FIG. 7 shows an exemplary screen shot 405*a* illustrating step 405. If the selections are accepted, the method proceeds to step 410; if the selections are rejected, the method returns to step 402.

Returning now to discuss step 406, the program 325 and/or the program 345 randomly selects five cards (the predetermined number in the current example) from the electronic first deck 110*a* and one card (the predetermined number in the current example) from the electronic second deck 110*b*.

Figure 8:
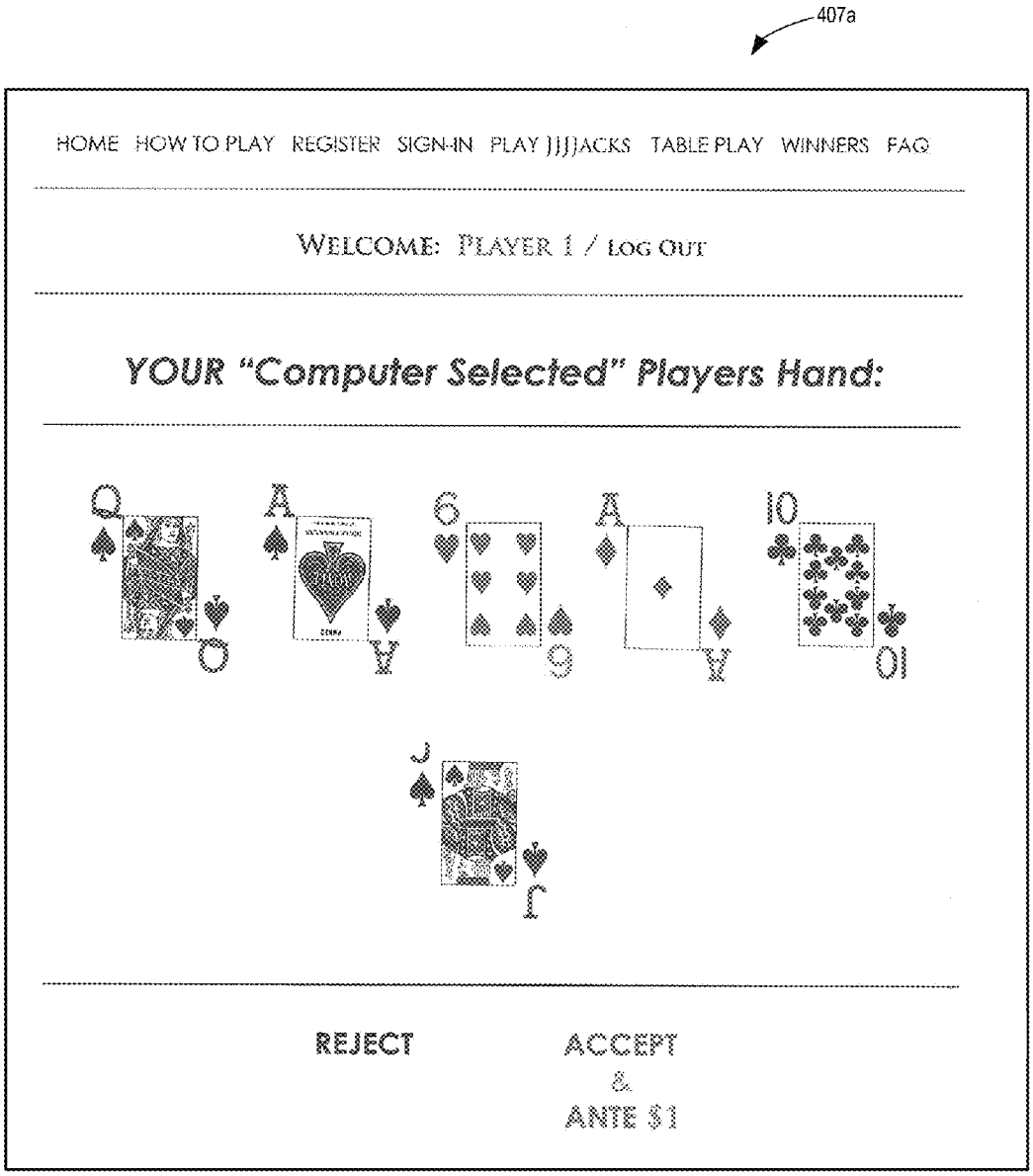

The method 400 continues from step 406 to step 407, where the cards selected at step 406 are displayed by the computer display 339. The player is presented with the option of accepting the selections made in step 406 and placing a wager or rejecting the selections made at step 406. FIG. 8 shows an exemplary screen shot 407*a* illustrating step 407. If the selections are accepted, the method 400 proceeds to step 410; if the selections are rejected, the method returns to step 402.

At step 410, a receipt is generated from program 325, providing a record of the accepted selections and the wager made. FIG. 9 shows an exemplary screen shot 410*a* illustrating step 410. The method 400 then continues to step 412, where the processor 312 determines whether enough wagers have been made to proceed to step 414. If not, the method 400 returns to step 401 to allow the same player or another player to make a subsequent wager. If enough wagers have been made, the method proceeds from step 412 to step 414 and the system 300 does not accept any further wagers.

Figure 10:
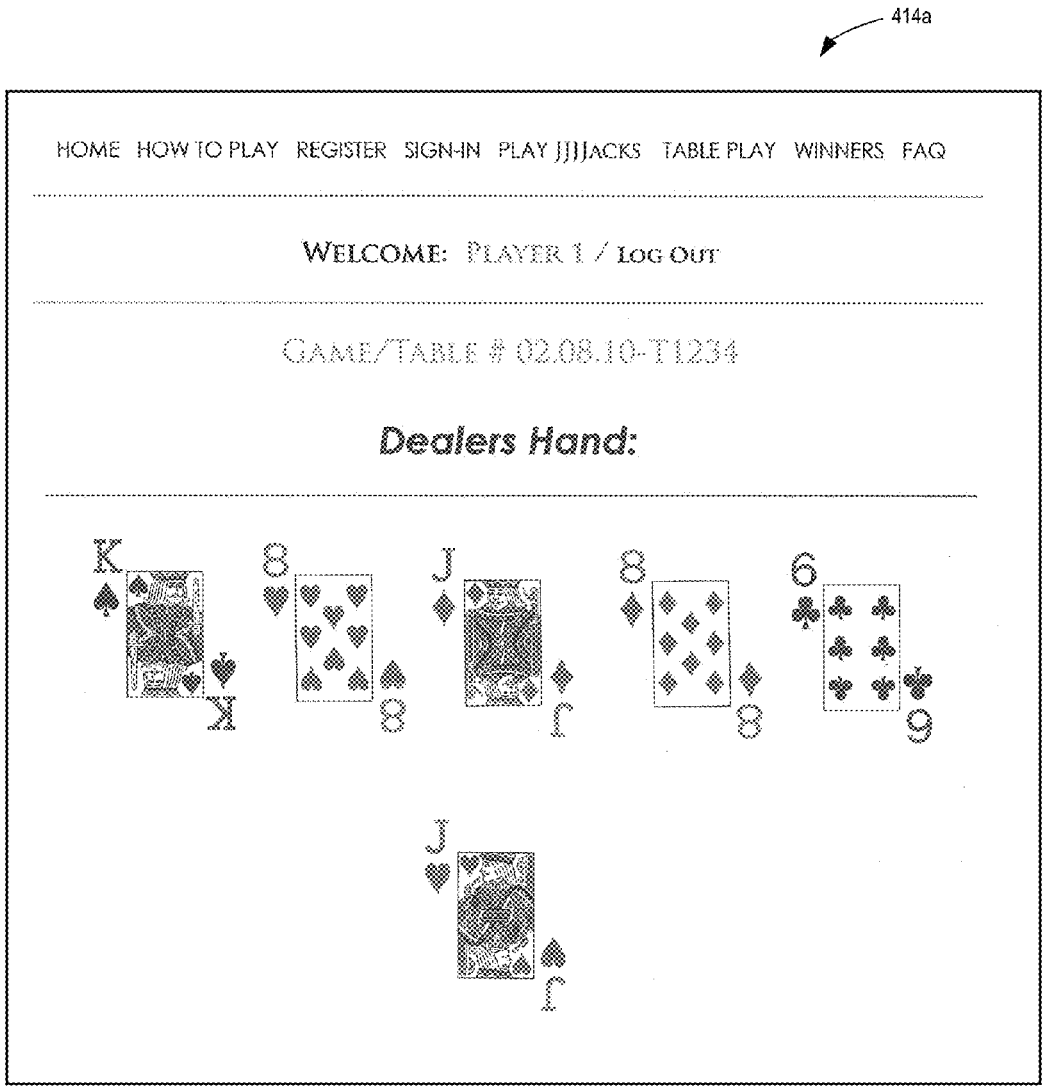

At step 414, the processor 312 selects five cards from the electronic first deck 110*a* and selects one card from the electronic second deck 110*b* (again, the predetermined numbers in the current example) using the program 325. FIG. 10 shows an exemplary screen shot 414*a* illustrating selections made at step 414. The method 400 continues to step 416, where the processor 312 determines if any players have selections that match those made in step 414 and identifies any players with matching selections.

Figure 11:
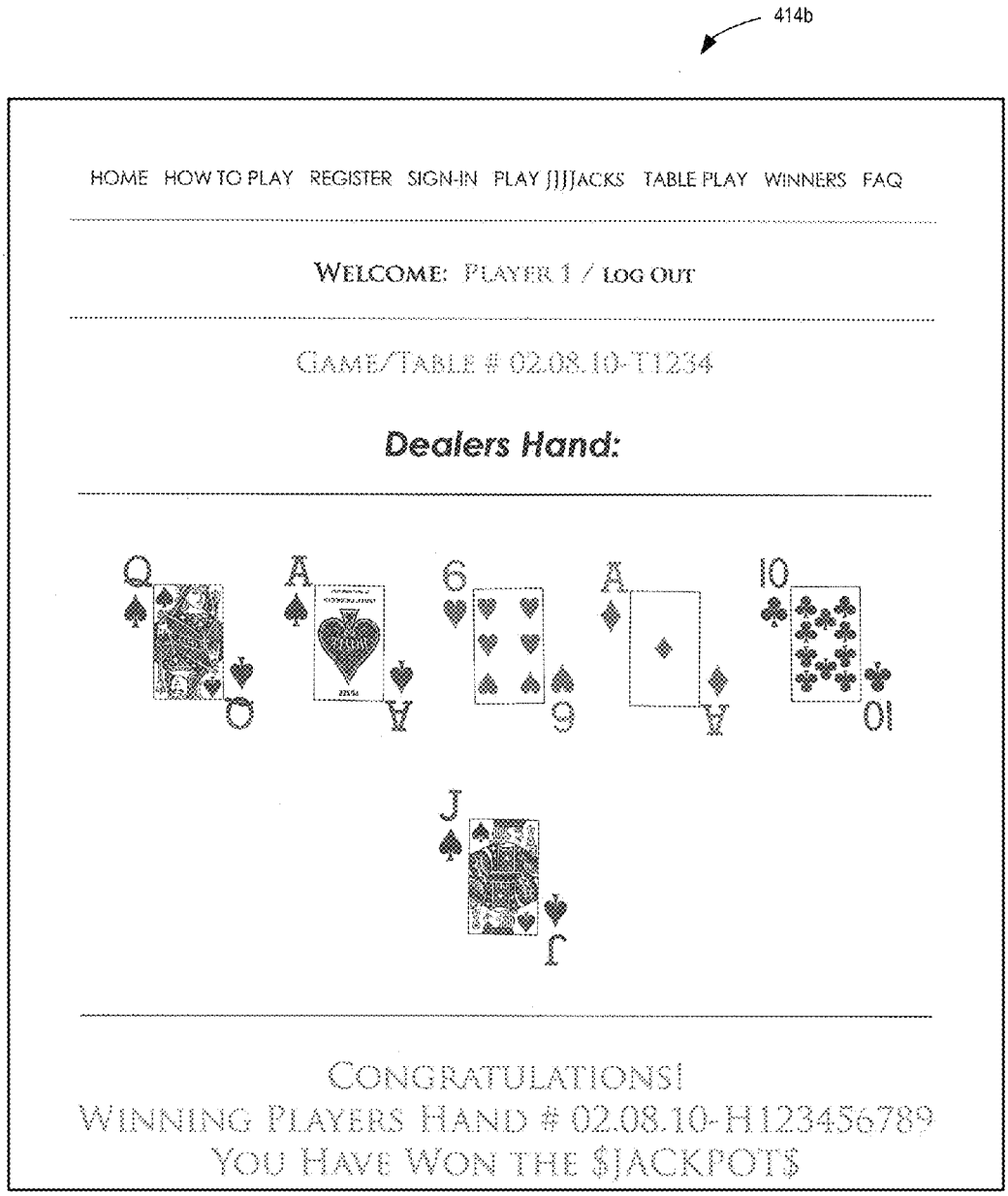

If no player has matching selections, the method 400 immediately returns to step 414 to again select five cards from the electronic first deck 110*a* and one card from the electronic second deck 110*b*. FIG. 11 shows an exemplary screen shot 414*b* illustrating selections made a subsequent (in this example, a fifth) time at step 414.

If at least one player does have matching selections, the method 400 advances from step 416 to step 420, where the processor 312 determines how many players were identified in step 416 as having matching selections and notifies the winning players. FIG. 11 further illustrates that the winning player(s) may be shown along with the selections made at step 414, though it may be desirable to have some interval of time between showing the selections and winners.

The method finally ends at step 422, where payouts are made to the winning player(s). While steps have been described in the method 400 as being performed in a particular order, various embodiments may utilize different sequences and/or different steps.

Many different arrangements of the various components depicted, as well as components not shown, are possible without departing from the spirit and scope of the present invention. Embodiments of the present invention have been described with the intent to be illustrative rather than restrictive, and alternative embodiments that do not depart from the invention's scope will become apparent to those skilled in the art. For example, while predetermined decks of cards have been primarily used to illustrate the inventive games and methods of implementation, a person skilled in the art would appreciate that the sets of choices 110*a* and 110*b* may each instead include a plurality of numbered balls, a ticket displaying a plurality of unique symbols, et cetera. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A computer having a processor in data communication with an electronic memory, an input device, an output device, and programming for implementing a game; the programming causing the processor to implement the steps comprising:

(a) providing a first set of choices;

(b) providing a second set of choices;

(c) accepting a predetermined number of uniform wagers from a plurality of players, the predetermined number being greater than one;

(d) associating a respective player hand with each uniform wager, each player hand having X elements from the first set and Y elements from the second set, at least one of the player hands differing from at least one other of the player hands, X being an integer greater than or equal to two, Y being an integer greater than or equal to one;

(e) after the predetermined number of uniform wagers are accepted, selecting a dealer hand having X elements from the first set and Y elements from the second set;

(f) determining whether the dealer hand matches exactly any of the respective player hands;

(g) for all occurrences of the dealer hand selected in step (e) failing to match exactly at least one of the player hands, repeating steps (e) and (f) without repeating step (d); and (h) awarding a payout to all of the player hands that match exactly a respective dealer hand.

2. The computer of claim 1, wherein each player is notified of his elements selected from the first and second sets of choices before wagering.

3. The computer of claim 1, wherein the first and second sets are provided electronically over a network.

4. The computer of claim 1, wherein the elements from the first set differ from the elements of the second set.

5. The computer of claim 1, wherein the elements from the first set are selected from the group consisting of: symbols and numbered balls.

6. The computer of claim 5, wherein the elements from the second set are selected from the group consisting of: symbols and numbered balls.

7. A computer having a processor in data communication with an electronic memory, an input device, an output device, and programming for implementing a game; the programming causing the processor to implement the steps comprising:

(a) providing a first set of electronic selections;

(b) providing a second set of electronic selections;

(c) accepting a predetermined number of uniform wagers from a plurality of players, the predetermined number being greater than one;

(d) associating a respective player hand with each uniform wager, each player hand having X electronic selections from the first set and Y electronic selections from the second set, at least one of the player hands differing from at least one other of the player hands, X being an integer greater than or equal to two, Y being an integer greater than or equal to one;

(e) determining whether a dealer hand having X electronic selections from the first set and Y electronic selections from the second set matches exactly any of the respective player hands;

(f) for all occurrences of the dealer hand failing to match exactly at least one of the player hands, determining whether a new dealer hand having X electronic selections from the first set and Y electronic selections from the second set matches exactly any of the respective player hands without repeating step (d); and (g) awarding a payout to all of the player hands that match exactly a respective dealer hand.

8. The computer of claim 7, wherein each player is notified of his electronic selections selected from the first and second sets before wagering.

9. The computer of claim 7, wherein the first and second sets are provided electronically over a network.

10. The computer of claim 7, wherein the electronic selections from the first set differ from the electronic selections from the second set.

11. The computer of claim 7, wherein the electronic selections from the first set are selected from the group consisting of: numbered balls and symbols.

12. The computer of claim 11, wherein the electronic selections from the second set are selected from the group consisting of: numbered balls and symbols.

13. A gaming system, comprising:

a primary station having programming and a processor; and at least one gaming station in data communication with the primary station, the at least one gaming station comprising:

an input device;

an output device;

a processor; and programming;

wherein at least one of the primary station programming and the gaming station programming causes at least one of the primary station processor and the at least one gaming station processor to implement the steps comprising:

(a) presenting a first set of indicia via the at least one output device;

(b) presenting a second set of indicia via the at least one output device;

(c) accepting a predetermined number of uniform wagers from a plurality of players of the at least one gaming station, the predetermined number being greater than one;

(d) associating a respective player hand with each of the uniform wagers a, each player hand having X indicia from the first set and Y indicia from the second set, the indicia in at least one of the player hands being different from the indicia in at least one other of the player hands, X being an integer greater than or equal to two, Y being an integer greater than or equal to one;

(e) after the predetermined number of uniform wagers are accepted, inputting a dealer hand having X indicia from the first set and Y indicia from the second set;

(f) determining whether the dealer hand selected in step (e) matches exactly any of the respective player hands;

(g) for all occurrences of the dealer hand selected in step (e) failing to match exactly at least one of the player hands, repeating steps (e) and (f) without repeating step (d); and (h) awarding a payout to all of the player hands that match exactly a respective dealer hand.

14. The system of claim 13, wherein the indicia from the first set differ from the indicia from the second set.

15. The system of claim 13, wherein the indicia from the first set are selected from the group consisting of: numbers and symbols.

* * * * *

UNITED STATES PATENT AND TRADEMARK OFFICE

CERTIFICATE OF CORRECTION

PATENT NO. : 8,733,759 B1
APPLICATION NO. : 13/734461
DATED : May 27, 2014
INVENTOR(S) : Donahoo It is certified that error appears in the above-identified patent and that said Letters Patent is hereby corrected as shown below:

IN THE CLAIMS:

Claim 13 (column 9, line 19): delete the word "a".

Signed and Sealed this
Twenty-fifth Day of November, 2014

Michelle K. Lee

Michelle K. Lee
*Deputy Director of the United States Patent and Trademark Office*